US006167952B1

(12) United States Patent
Downing

(10) Patent No.: US 6,167,952 B1
(45) Date of Patent: Jan. 2, 2001

(54) COOLING APPARATUS AND METHOD OF ASSEMBLING SAME

(75) Inventor: Robert Scott Downing, Rockford, IL (US)

(73) Assignee: Hamilton Sundstrand Corporation, Rockford, IL (US)

( * ) Notice: Under 35 U.S.C. 154(b), the term of this patent shall be extended for 0 days.

(21) Appl. No.: 09/033,926

(22) Filed: Mar. 3, 1998

(51) Int. Cl.[7] ..... F28D 9/00; F28F 3/08

(52) U.S. Cl. ..... 165/167; 165/80.4; 165/DIG. 360; 165/DIG. 364

(58) Field of Search ..... 165/80.4, 165, 165/167, 168, 170, 185

(56) References Cited

U.S. PATENT DOCUMENTS

| | | | |
|---|---|---|---|
| Re. 20,139 | 10/1936 | Pick | 257/245 |
| 2,571,631 | 10/1951 | Trumpler | 257/245 |

(List continued on next page.)

FOREIGN PATENT DOCUMENTS

| | | |
|---|---|---|
| 58501 | 9/1891 | (DE) . |
| 166779 | 9/1950 | (DE) . |
| 880591 | 6/1953 | (DE) . |
| 23 33 697 | 1/1975 | (DE) . |
| 27 53 189 | 6/1978 | (DE) . |
| 33 39 932 A1 | 5/1985 | (DE) . |
| 297 00 786 U1 | 6/1997 | (DE) . |
| 58637 | 4/1941 | (DK) . |
| 0 164 098 | 6/1985 | (EP) . |
| 0 467 217 A1 | 7/1991 | (EP) . |
| 0 866 500 A2 | 9/1998 | (EP) . |
| 990144 | 9/1951 | (FR) . |
| 991096 | 10/1951 | (FR) . |
| 604464 | 7/1948 | (GB) . |
| 691967 | 5/1953 | (GB) . |
| 857707 | 1/1961 | (GB) . |
| 1197449 | 7/1970 | (GB) . |
| 2093582 | 9/1982 | (GB) . |
| 116 1810 | 6/1985 | (SU) . |
| 126 8930 A1 | 11/1986 | (SU) . |
| 167 3826 A1 | 8/1991 | (SU) . |
| 167 7477 A1 | 9/1991 | (SU) . |

OTHER PUBLICATIONS

Grote et al., "Test Results of Wafer Thin Coolers at Heat Fluxes from 5 to 125 W/cm$^2$", SAE Technical Paper Series, 18th Intersociety Conference on Environmental Systems, San Francisco, California, Jul. 11–13, 1988, 16 pages.

Bland et al., "A Compact High Intensity Cooler (CHIC)", SAE Technical Paper Series, Thirteenth Intersociety Conference on Environmental Systems, San Francisco, California, Jul. 11–13, 1983, 15 pages.

Abstract of Japanese Patent Publication No. 57–90592 published Jun. 5, 1982 (Japanese Patent Application No. 55–164986).

*Primary Examiner*—Allen Flanigan
(74) *Attorney, Agent, or Firm*—Marshall, O'Toole, Gerstein, Murray & Borun

(57) ABSTRACT

A cooling apparatus includes first and second laminations each having a plurality of openings wherein the openings of the first and second laminations are substantially coincident when the laminations are disposed in identical orientations and the first lamination is aligned with and overlies the second lamination. The first and second laminations are bonded in a stacked and aligned relationship in different orientations such that passages are formed extending through the laminations.

21 Claims, 10 Drawing Sheets

U.S. PATENT DOCUMENTS

| | | | |
|---|---|---|---|
| 2,656,159 | 10/1953 | Holm et al. | 257/245 |
| 2,782,009 | 2/1957 | Rippingille | 257/245 |
| 3,102,532 | 9/1963 | Shoemaker | 126/270 |
| 3,258,832 | 7/1966 | Gerstung | 29/157.3 |
| 3,308,879 | 3/1967 | Maddocks | 165/167 |
| 3,341,925 | 9/1967 | Gerstung | 29/157.3 |
| 3,345,735 | 10/1967 | Nicholls | 29/470.9 |
| 3,631,923 | 1/1972 | Izeki | 165/167 |
| 3,731,737 | 5/1973 | Jenssen | 165/167 |
| 3,814,172 | 6/1974 | Shore | 165/12 |
| 3,862,661 | 1/1975 | Kovalenko et al. | 165/166 |
| 4,016,928 | 4/1977 | Bartels et al. | 165/141 |
| 4,156,459 | 5/1979 | Kusuda et al. | 165/167 |
| 4,162,703 | 7/1979 | Bosaeus | 165/167 |
| 4,359,181 | 11/1982 | Chisholm | 228/183 |
| 4,368,779 | 1/1983 | Rojey et al. | 165/165 |
| 4,489,778 | 12/1984 | Skoog | 165/166 |
| 4,494,171 | 1/1985 | Bland et al. | 361/386 |
| 4,516,632 | 5/1985 | Swift et al. | 165/167 |
| 4,559,580 | 12/1985 | Lutfy | 361/385 |
| 4,624,305 | 11/1986 | Rójey | 165/165 |
| 4,631,573 | 12/1986 | Sutrina | 357/82 |
| 4,665,975 | 5/1987 | Johnston | 165/167 |
| 4,680,673 | 7/1987 | Taverdet | 361/385 |
| 4,696,342 | 9/1987 | Yamauchi et al. | 165/152 |
| 4,762,172 | 8/1988 | Grehier et al. | 165/165 |
| 4,765,397 | 8/1988 | Chrysler et al. | 165/104.33 |
| 4,941,530 | 7/1990 | Crowe | 165/104.33 |
| 4,975,803 | 12/1990 | Niggemann | 361/385 |
| 5,058,665 | 10/1991 | Harada | 165/164 |
| 5,087,505 | 2/1992 | Schulz-Harder | 428/192 |
| 5,088,005 | 2/1992 | Ciaccio | 361/385 |
| 5,193,611 | 3/1993 | Hesselgreaves | 165/165 |
| 5,212,004 | 5/1993 | Böttcher et al. | 428/131 |
| 5,353,192 | 10/1994 | Nordin | 361/700 |
| 5,382,830 | 1/1995 | Akyürek et al. | 257/701 |
| 5,423,376 | 6/1995 | Julien et al. | 165/80.4 |
| 5,518,071 | 5/1996 | Lee | 165/185 |
| 5,650,662 | 7/1997 | Edwards et al. | 257/700 |
| 5,727,618 * | 3/1998 | Mundinger et al. | 165/80.4 |

* cited by examiner

COOLING APPARATUS AND METHOD OF ASSEMBLING SAME

TECHNICAL FIELD

The present invention relates generally to cooling devices, and more particularly to cooling apparatus, for example, for high power solid state devices, and a method of assembling same.

BACKGROUND ART

Higher packaging densities and increasing power dissipation of electronic devices make thermal management an extremely important design consideration so that reliability is enhanced. Because of the high heat fluxes that are encountered, future high power electronics for commercial aircraft and aerospace installations will likely be liquid cooled. In these applications where space and weight are important, compact cold plates and device coolers are needed. Further, the devices should be low cost and provide high performance cooling, for example, of solid state power devices used in variable speed, constant frequency power generation systems, DC converters, motor drives, inverters, variable frequency converters and bidirectional converters.

In applications employing high power electronic devices, high performance liquid plate fin heat exchangers or impingement type coolers have been used. Such devices have surface density ranges on the order of 500–1000 and 1500–2500 square meters of surface area per cubic meter of exchanger volume, respectively. While these surface density values are impressive, there are instances where an even greater increase in surface density is necessary or desirable. Further, because cooling requirements vary substantially from application to application, prior cooling devices have either been individually designed for the specific application or an already existing cooling device has been selected having a cooling performance which is equal to or greater than the required cooling performance. In the former case, the need to develop a design can increase overall costs beyond an acceptable level. In the latter case, inefficiencies are often encountered due to the oversizing of the cooling device.

Patents disclosing cooling devices include Jenssen U.S. Pat. No. 3,731,737, Skoog U.S. Pat. No. 4,489,778, Bland et al. U.S. Pat. No. 4,494,171, Lutfy U.S. Pat. No 4,559,580, Sutrina U.S. Pat. No. 4,631,573, Yamauchi et al. U.S. Pat. No. 4,696,342, Crowe U.S. Pat. No. 4,941,530 and Lee U.S. Pat. No. 5,518,071. The Bland et al., Lutfy, Sutrina and Crowe patents are owned by the assignee of the present application.

SUMMARY OF THE INVENTION

A cooling apparatus according to the present invention is configurable and easily assembled to have a selected cooling capability tailored to the requirements of the particular application so that the desired thermal performance can be obtained with the least requirements on the cooling flow.

More particularly, according to one aspect of the present invention, a cooling apparatus includes first and second laminations each having a plurality of openings wherein the openings of the first and second laminations are substantially coincident when the laminations are disposed in identical orientations and the first lamination is aligned with and overlies the second lamination. In addition, means are provided for maintaining the first and second laminations in a stacked and aligned relationship and in different orientations wherein passages are formed extending through the laminations.

In accordance with the preferred embodiment, the openings of each lamination are disposed in a regularly spaced pattern which is non-symmetric with respect to a center line of the lamination. Further, the first and second laminations are preferably identical to one another. Also, the maintaining means preferably maintains the first lamination in a first orientation and the second lamination in one of second and third orientations different than the first orientation.

Still further in accordance with the preferred embodiment, the openings in each lamination comprise slots which may be disposed in rows and columns between headers and which may be inclined relative to four sides of the lamination.

The passages preferably have a zig-zag shape and may have a first set of flow characteristics when the laminations are disposed in a first orientation configuration and a second set of flow characteristics different than the first set of flow characteristics when the laminations are disposed in a second orientation configuration.

In accordance with a further aspect of the present invention, the cooling apparatus includes a plurality of substantially identical stacked laminations arranged in differing orientations and each having openings and means for securing the laminations together to form cooling passages extending through the laminations.

In accordance with yet another aspect of the present invention, a lamination for cooling apparatus comprises a body of lamination material having a plurality of slanted openings therethrough disposed in a regularly spaced pattern which is non-symmetric with respect to a center line of the lamination and first and second header portions disposed on opposing sides of the pattern.

In accordance with a still further aspect of the present invention, a method of assembling cooling apparatus includes the steps of providing first and second laminations each having a plurality of openings wherein the openings of the first and second laminations are substantially coincident when the laminations are disposed in identical orientations and the first lamination is aligned with and overlies the second lamination and securing the first and second laminations in a stacked and aligned relationship and in different orientations wherein passages are formed extending through the laminations.

Other features and advantages are inherent in the apparatus claimed and disclosed or will become apparent to those skilled in the art from the following detailed description in conjunction with the accompanying drawings.

DESCRIPTION OF THE PREFERRED EMBODIMENTS

In accordance with an aspect of the present invention, a cooling device core is composed of a bonded stack of identical laminations which contain evenly spaced, flow slots which are preferably angled and aligned in rows and columns. A plurality of back and forth (i.e., zig-zag) cooling passages are formed by overlapping slots in the alternate laminations (or groups of laminations) that are flipped within the stack. The flow characteristics (pressure drop and heat transfer) of the resultant cooling passages are selected in the design by the features of the slots (width, length, spacing and angle), but can be later varied by the orientation of the laminations in the stack. The zig-zag flow pattern promotes turbulence and improves heat transfer.

Figure 1:
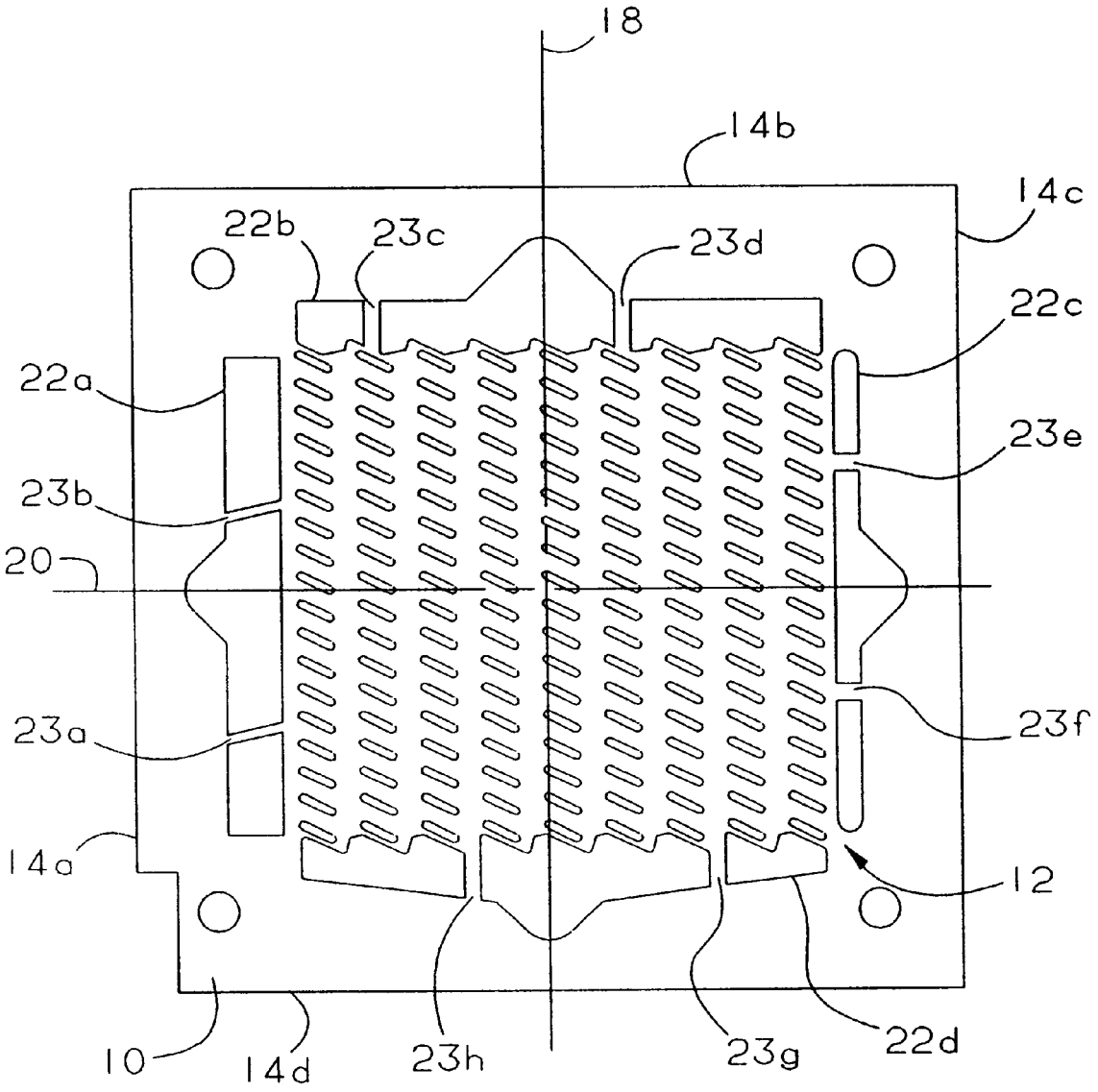
FIG. 1 is an elevational view of a lamination for use in a cooling device according to one embodiment of the present invention.

Referring now to FIG. 1, a lamination 10 for cooling apparatus according to one embodiment of the present invention is illustrated. The lamination 10, which may be fabricated of any suitable thermally conductive material, such as copper, includes a plurality of openings generally indicated at 12, which are arranged in rows and columns. The lamination 10 is in the shape of a rectangle having four sides 14*a*–14*d*. More particularly, the sides 14*a*–14*d* are preferably of equal length and hence the lamination 10 has a square shape. Preferably, the columns of openings 12 are parallel to the sides 14*a*, 14*c* whereas the rows of openings 12 are parallel to the sides 14*b*, 14*d*.

If desired, the lamination could have a different overall shape, for example, any overall shape (i.e., outline) having two axes of symmetry, such as a circle, an ellipse, a hexagon, etc.

Also in accordance with the preferred embodiment, the openings 12 are arranged in a pattern which is nonsymmetric with respect to at least one, and preferably two center lines or central axes 18, 20. Still further in accordance with the preferred embodiment, the openings 12 comprise slots which are all parallel to one another and slanted at a particular angle with respect to an arbitrary line, such as the central axis 20. As noted in greater detail hereinafter, the angle at which each opening 12 is inclined relative to the central axis 20 determines flow characteristics of the passages formed by the combinations of stacked openings 12.

Disposed adjacent the sides 14*a*–14*d* are a series of openings comprising headers 22*a*–22*d*, respectively. Optional support ribs 23*a*–23*h* lend structural support to the lamination portions on either side of the headers 22*a*–22*d*. The headers 22*a* and 22*c* and the ribs 23*a*, 23*b* and 23*e*, 23*f* are non-symmetric with respect to the central axis 18. In like fashion, the headers 22*b* and 22*d* and the ribs 23*c*, 23*d* and 23*g*, 23*h* are non-symmetric with respect to the central axis 20. The significance of this relationship will be described hereinafter.

The openings 12 and the headers 22*a*–22*d* may be formed in the lamination 10 by laser or water jet cutting, punching, stamping and/or photochemical etching or any other suitable process.

Figure 2:
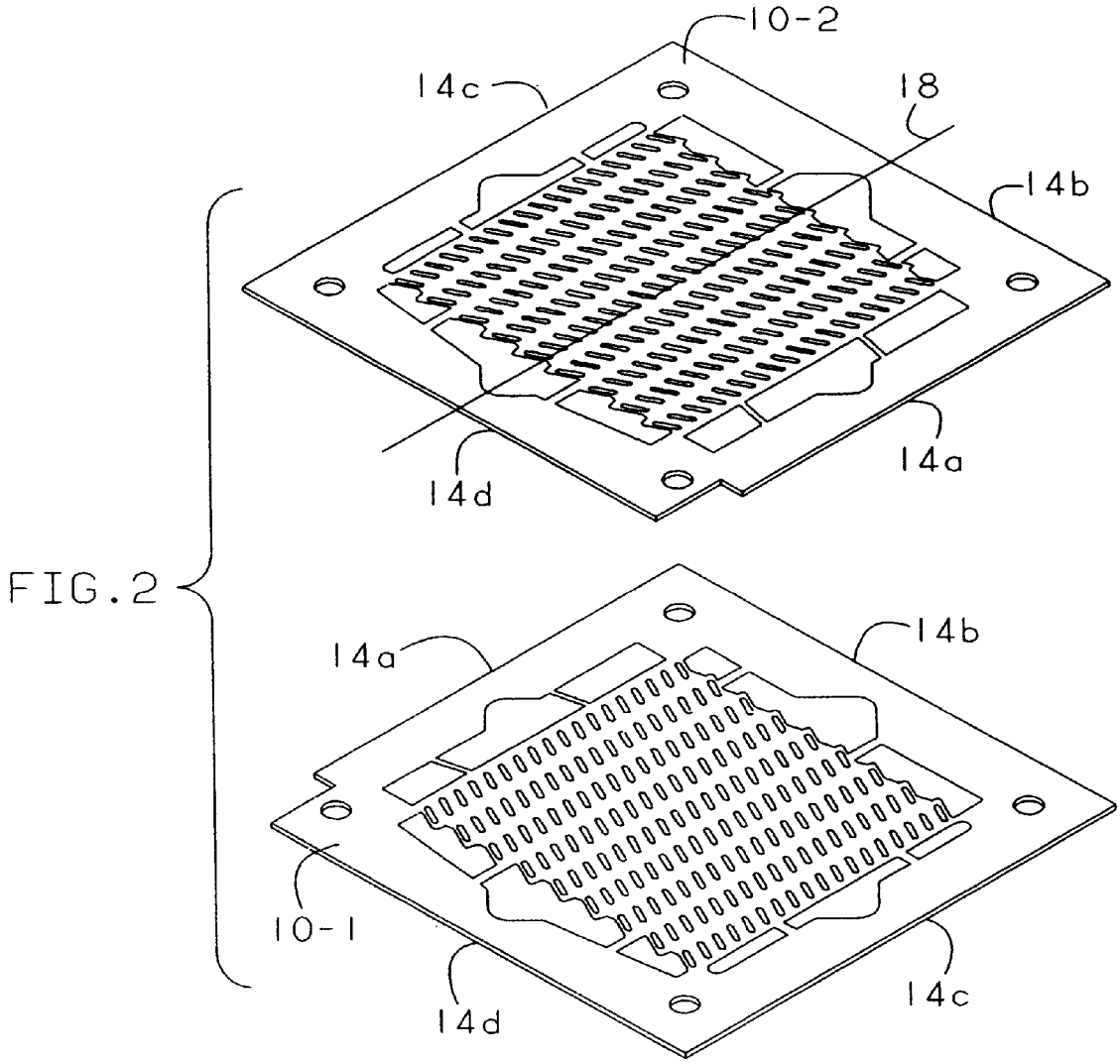
FIG. 2 is an exploded perspective view of two laminations, each identical to the lamination of FIG. 1, and disposed in a first orientation configuration.
Figure 3:
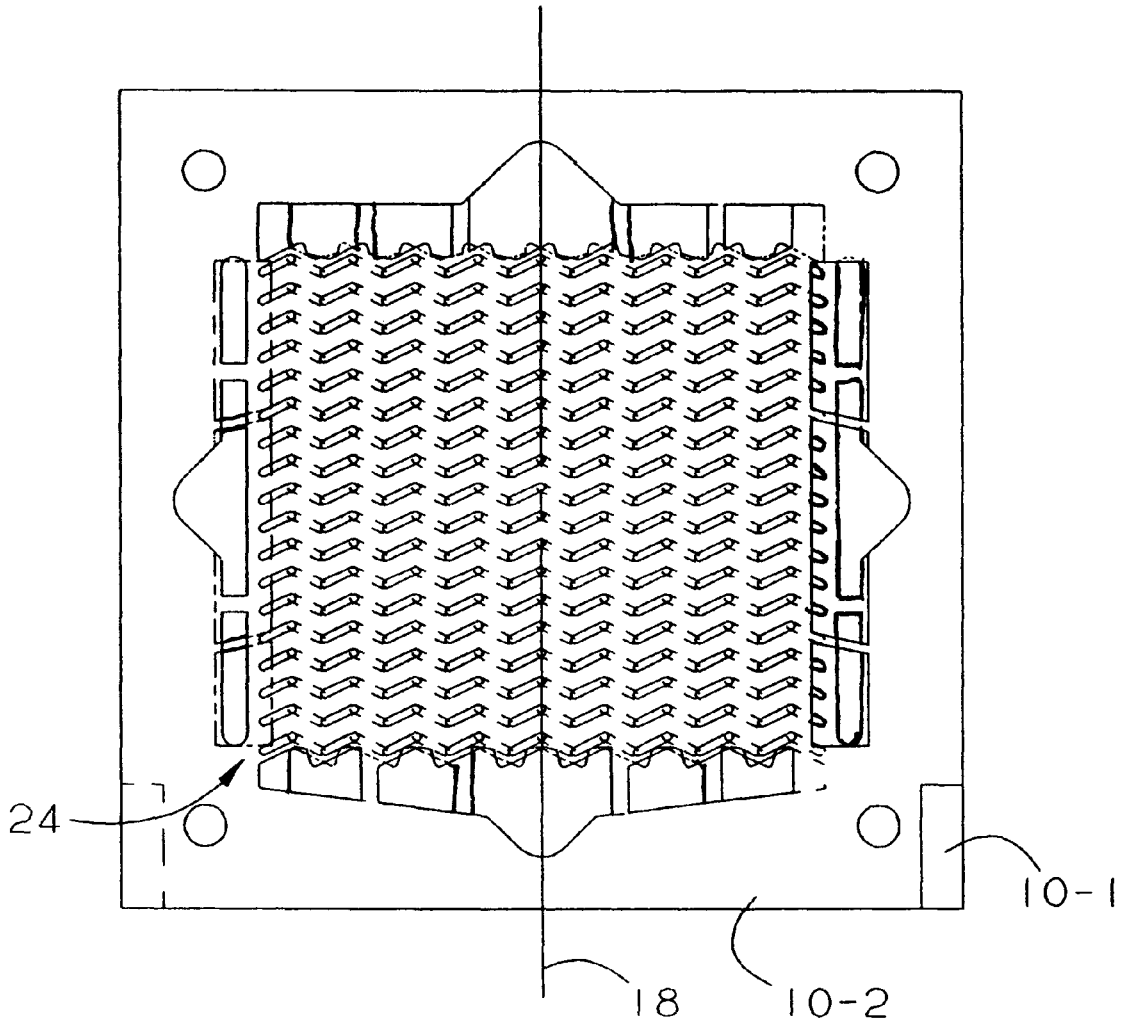
FIG. 3 is an elevational view of the laminations of FIG. 2 after assembly thereof in stacked and aligned relationship.

Referring now to FIG. 2, first and second laminations 10-1 and 10-2, each identical to the lamination 10 of FIG. 1, are shown in a first orientation configuration. The lamination 10-1 is shown in a first orientation whereby the side 14*a* is shown on the left, the side 14*c* is shown on the right and the sides 14*b* and 14*d* are shown as being farther away and nearer to the viewer, respectively. The lamination 10-2 is shown in a second orientation different than the first orientation wherein the side 14*a* is shown on the right and the side 14*c* is shown on the left while the sides 14*b* and 14*d* are shown as being farther away from and closer to the viewer, respectively. The second lamination 10-2 can be thought of as-having been flipped 180° about the central axis 18 relative to the first lamination 10-1. When the laminations 10-1 and 10-2 are assembled together in stacked alignment, passages 24 are formed. The passages 24 extend between the overlapped headers 22*a*, 22*c* on the left-hand side of the laminations 10-1, 10-2, respectively, and the overlapped headers 22*c*, 22*a* on the right-hand side of the laminations 10-1, 10-2, respectively. The passages 24 have a back-and-forth or zig-zag shape and extend through overlapped openings 12 in the laminations, i.e., the passages 24 extend through an opening 12 in the lamination 10-1, and then extend down between laminations into the adjacent lamination 10-2 and thence extend laterally through an adjacent opening 12 in the lamination 10-2. The passages 24 then extend up between the laminations 10-2 and 10-1 and thereafter extend laterally through an opening 12 in the lamination 10-1, and so on. Fluid communication between the ends of the passages and the headers is accomplished by overlapping of the header 22*a* of the lamination 10-2 with the openings 12 in the right-most column of openings through the lamination 10-1, and further by overlapping of the header 22-*a* of the lamination 10-1 with the openings 12 in the left most column of openings of the lamination 10-2. As seen in FIG. 3, the included angle between adjacent and overlapping openings in the laminations 10-1 and 10-2 is relatively shallow and, in the preferred embodiment, is equal to approximately 120°.

Figure 4:
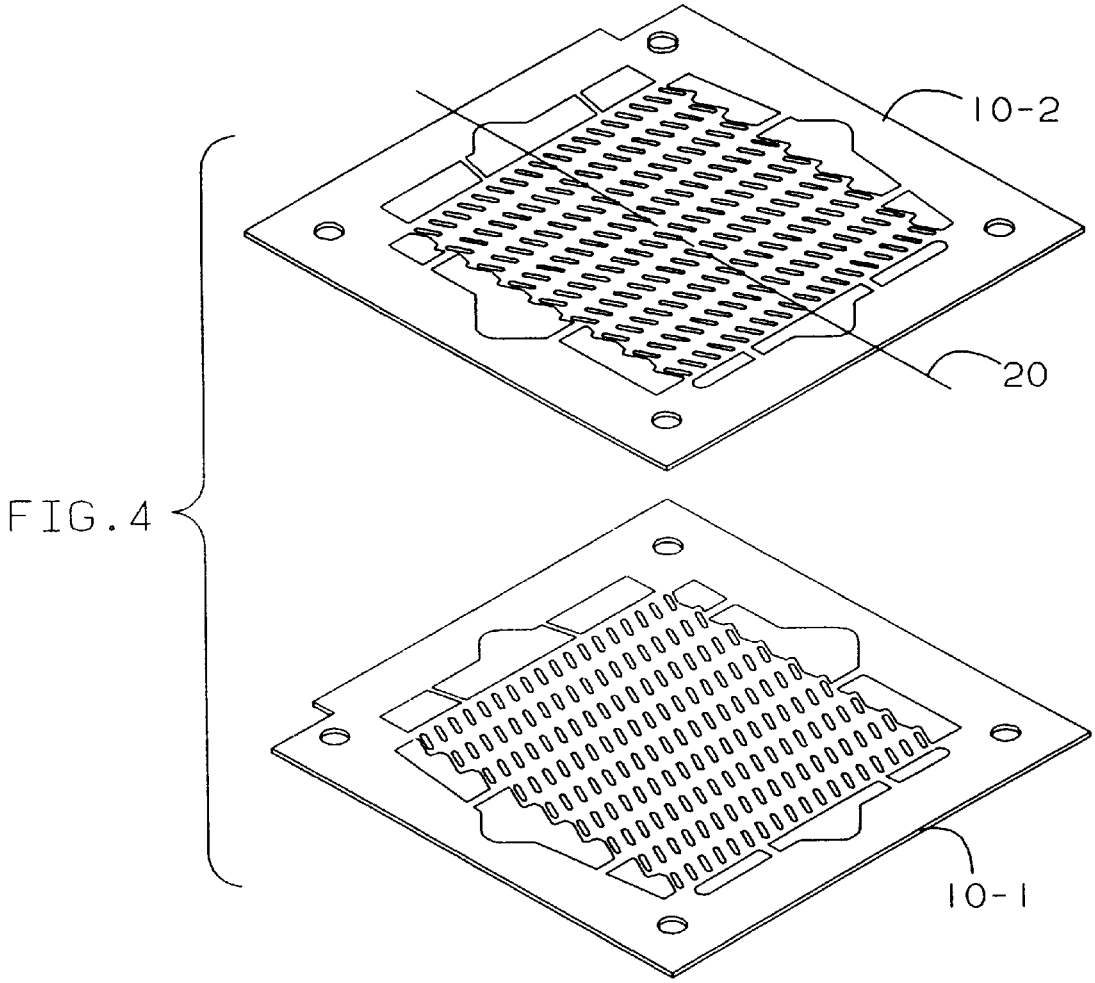
FIG. 4 is a view similar to FIG. 2, illustrating two laminations, each identical to the lamination of FIG. 1, and disposed in a second orientation configuration.
Figure 5:
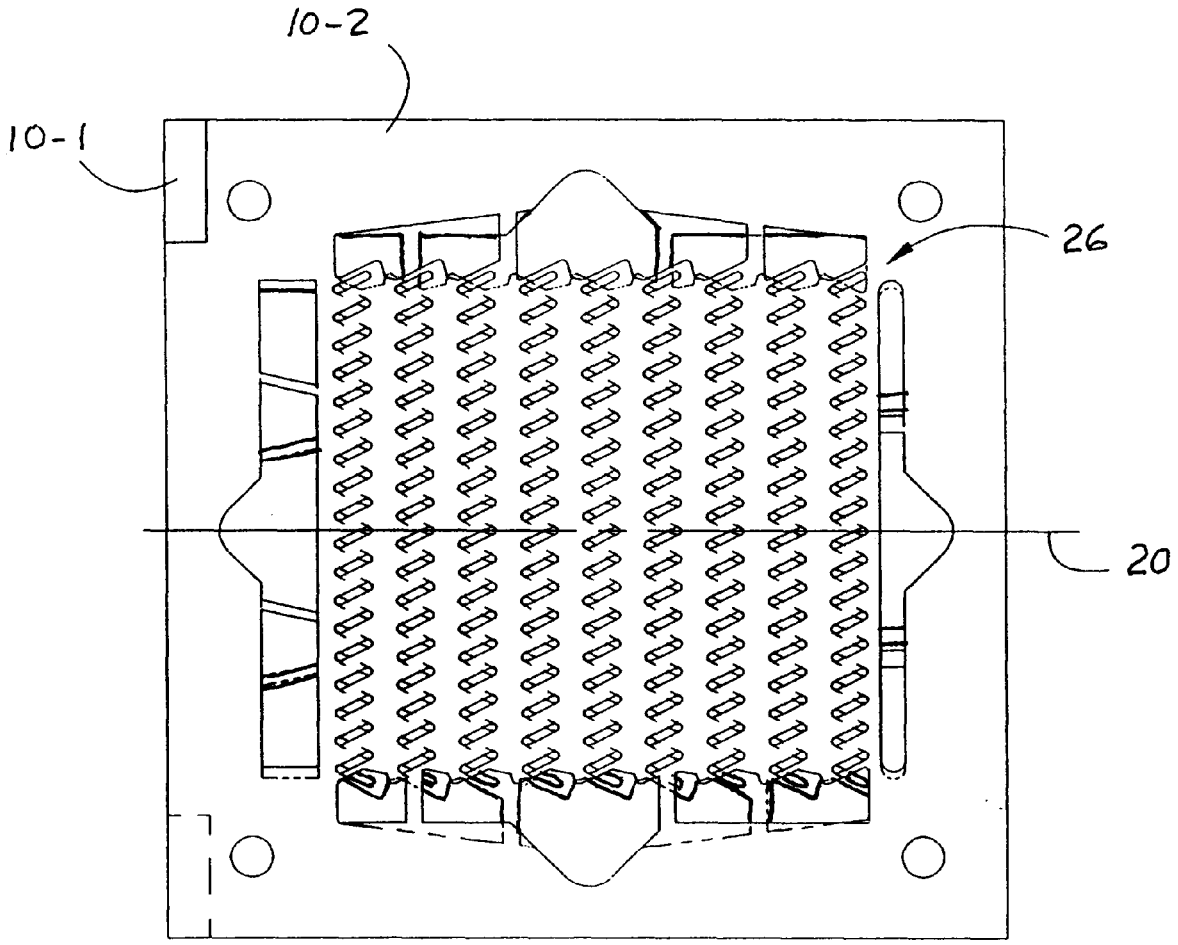
FIG. 5 is a view similar to FIG. 3 illustrating the laminations of FIG. 4 after assembly thereof in stacked and aligned relationship.

FIG. 4 illustrates the laminations 10-1 and 10-2 in a second, different orientation configuration. In this case, the lamination 10-2 is flipped 180° about the central axis 20 relative to the lamination 10-1. Thus, as seen in FIG. 5, when the laminations 10-1 and 10-2 are aligned with one another, a second set of passages 26 is thereby formed, this time extending between the headers 22*b*, 22*d* at the lower end of the laminations of FIG. 5 and extending to the upper aligned headers 22*d*, 22*b* in the laminations 10-2, 10-1, respectively. In this configuration, fluid communication is established through overlap of the header 22*b* of the lamination 10-2 with the lowermost row of the openings 12 in the lamination 10-1. Fluid communication is also established at the upper end of the openings 12 in the lamination 10-2 by overlap with the header 22*b* of the lamination 10-1.

As seen in FIG. 5, the passages 26 again have a back-and-forth or zig-zag shape, although the included angles between adjacent openings in the laminations 10-1 and 10-2 are acute. Preferably, this angle is substantially equal to approximately 60°.

A comparison of FIGS. 3 and 5 illustrates the differences in the flow passages in the first and second orientation configurations. Because the angles of the flow passages are relatively gentle in the orientation configuration of FIG. 3, this configuration has a lower pressure drop and heat transfer performance than the configuration illustrated in FIG. 5. The sharper turn angles in the embodiment of FIG. 5 provide greater turbulence and increase heat transfer, with a higher pressure drop.

It should be noted that the width and lengths of the openings 12, the thickness of each lamination 10, the area over which openings in adjacent laminations overlap and the angle of the openings with respect to the central axis 20 all affect the thermal and hydraulic performance of the cooling device. Once the design parameters are optimized for a specific cooling apparatus design, the stacking arrangement can be used to select a cooler performance.

Figure 8:
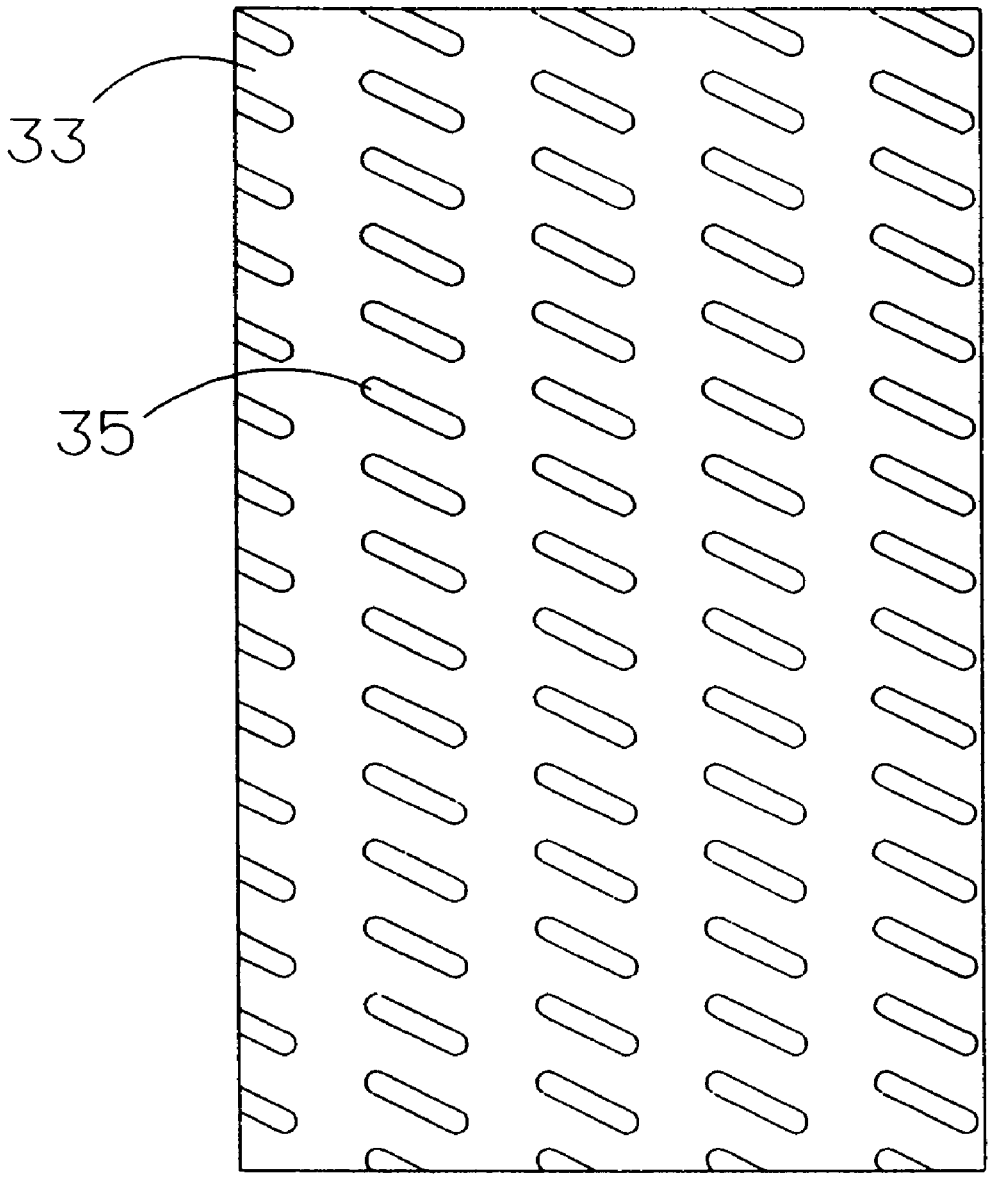
FIG. 8 illustrates a lamination for use in a cooling device according to a further embodiment of the present invention.
Figure 9:
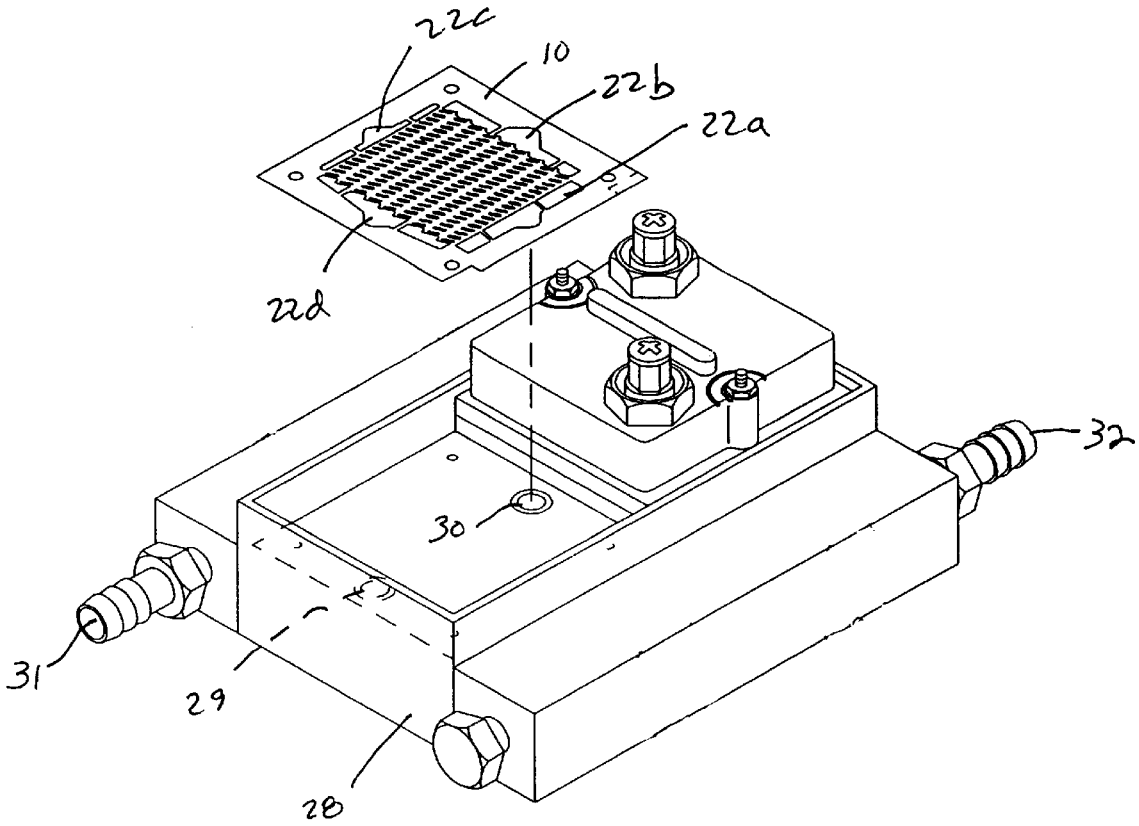
FIG. 9 comprises an isometric view of an apparatus incorporating stacked laminations, one of which is shown in the figure.

As necessary or desirable, any number of laminations can be stacked in alterative orientations according to FIG. 2 or FIG. 4. As seen in FIG. 9, the stacked laminations may be placed in an apparatus 28 such that, for example, the headers 22*b*, 22*d* of one of the laminations overlie inlet and outlet ports 29, 30, respectively. The ports 29, 30 are in fluid communication with inlet and outlet conduits 31, 32, respectively. Coolant fluid flows through the conduit 31 and the inlet port 29 into the stacked laminations. Flow through the passages 24 or 26 alternately occurs from top-to-bottom and bottom-to-top and coolant exits through the outlet port 30 and the conduit 32. Any device to be cooled may be soldered or otherwise secured directly to the laminations. Alternatively, the device may be mounted on a thermally conductive plate (fabricated of, for example, a ceramic or metallic material, depending upon whether electrical isolation is required) secured atop and in thermal contact with the laminations. Because the optional ribs 23*a*–23*h* are non-symmetric with respect to the axes 18, 20, the ribs 23 in each lamination are offset with respect to ribs in adjacent laminations so that flow is not impeded. Alternatively, by removing the headers of the laminations, coolant flow into and out of the stacked laminations can occur laterally, i.e., from the side. If flow entry and exit occurs laterally, laminations like the lamination 33 of FIG. 8 can be stacked. This embodiment may be used in applications where the cooler is to be "dropped into" a manifold structure. In this case, openings 35 in at least one of the columns and one of the rows must intersect the edges of the lamination. Adjacent laminations may be in alternating orientations as seen in FIGS. 2 and 4 (or may be in any of the orientation configurations noted hereinafter) and further may be disposed in a housing having manifolds extending to the edges of the laminations.

Figure 6:
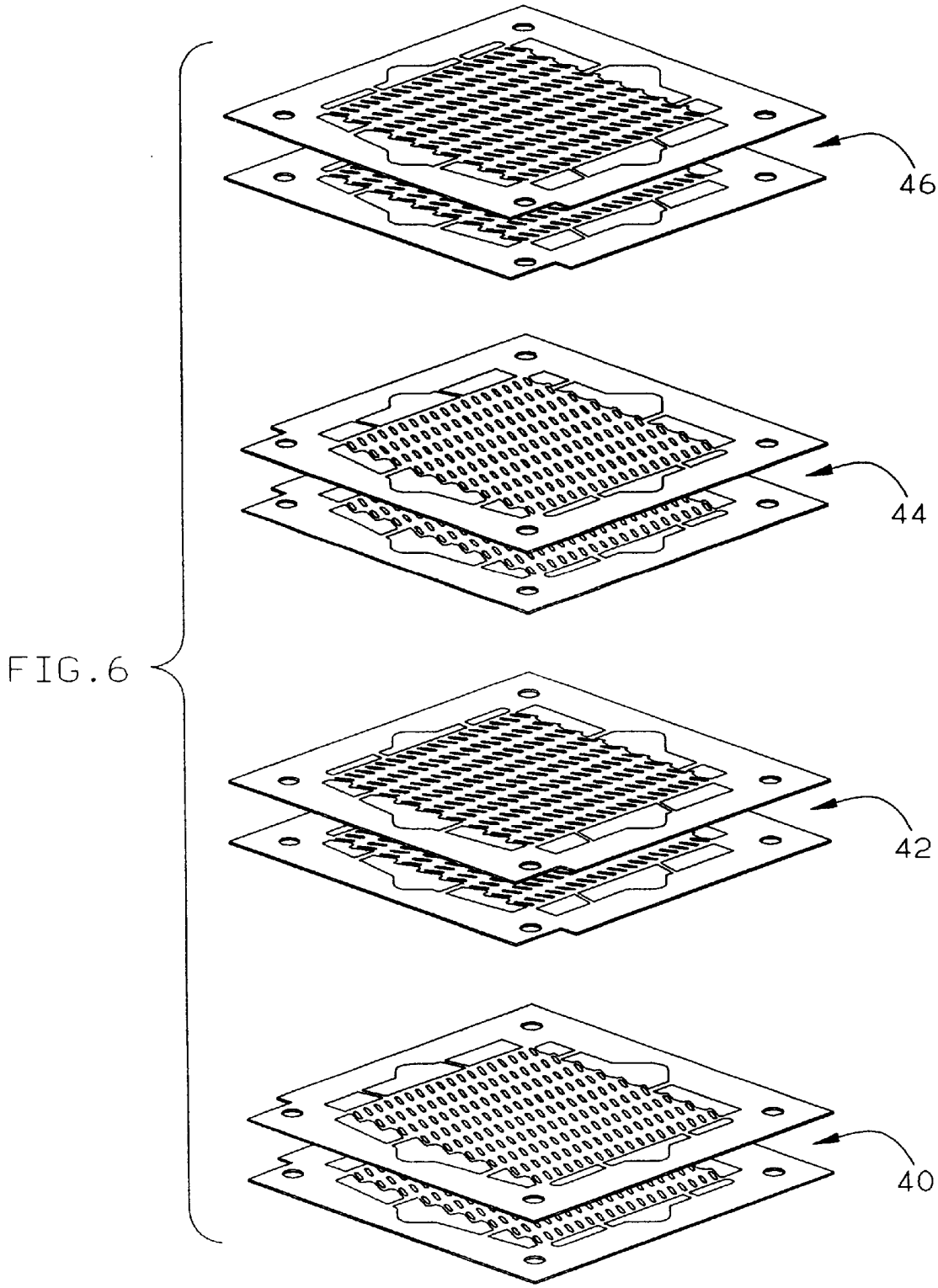
FIG. 6 is an exploded perspective view of a plurality of laminations, each identical to the lamination of FIG. 1, and arranged in groups of alternating configuration.

Instead of alternating the orientation of individual laminations, groups of laminations may have alternating orientations. FIG. 6 illustrates such a combination of laminations wherein first through fourth groups of laminations 40, 42, 44 and 46, respectively, are stacked in an aligned relationship. The laminations within each group 40–46 are identically aligned; however, the laminations within the groups 40 and 44 are disposed in a first orientation whereas the laminations of the groups 42 and 46 are disposed in a second, different orientation. For example, the laminations of the groups 40 and 44 may be disposed in the orientation of the lamination 10-1 of FIGS. 2 and 4 whereas the laminations of the groups 42 and 46 may be disposed in either of the orientations of the lamination 10-2 of FIGS. 2 and 4. Of course, the number of laminations in each group and the number of groups may vary from those shown. Also, the number of laminations in one group may be the same as or different than the number of laminations in any or all of the remaining groups. By providing groups of laminations all with the same orientation, the effective flow passage cross-sectional size can be made larger. The number of laminations in each group can be selected to tune the design to the desired heat transfer performance and corresponding flow resistance without the need for additional lamination design.

Figure 7:
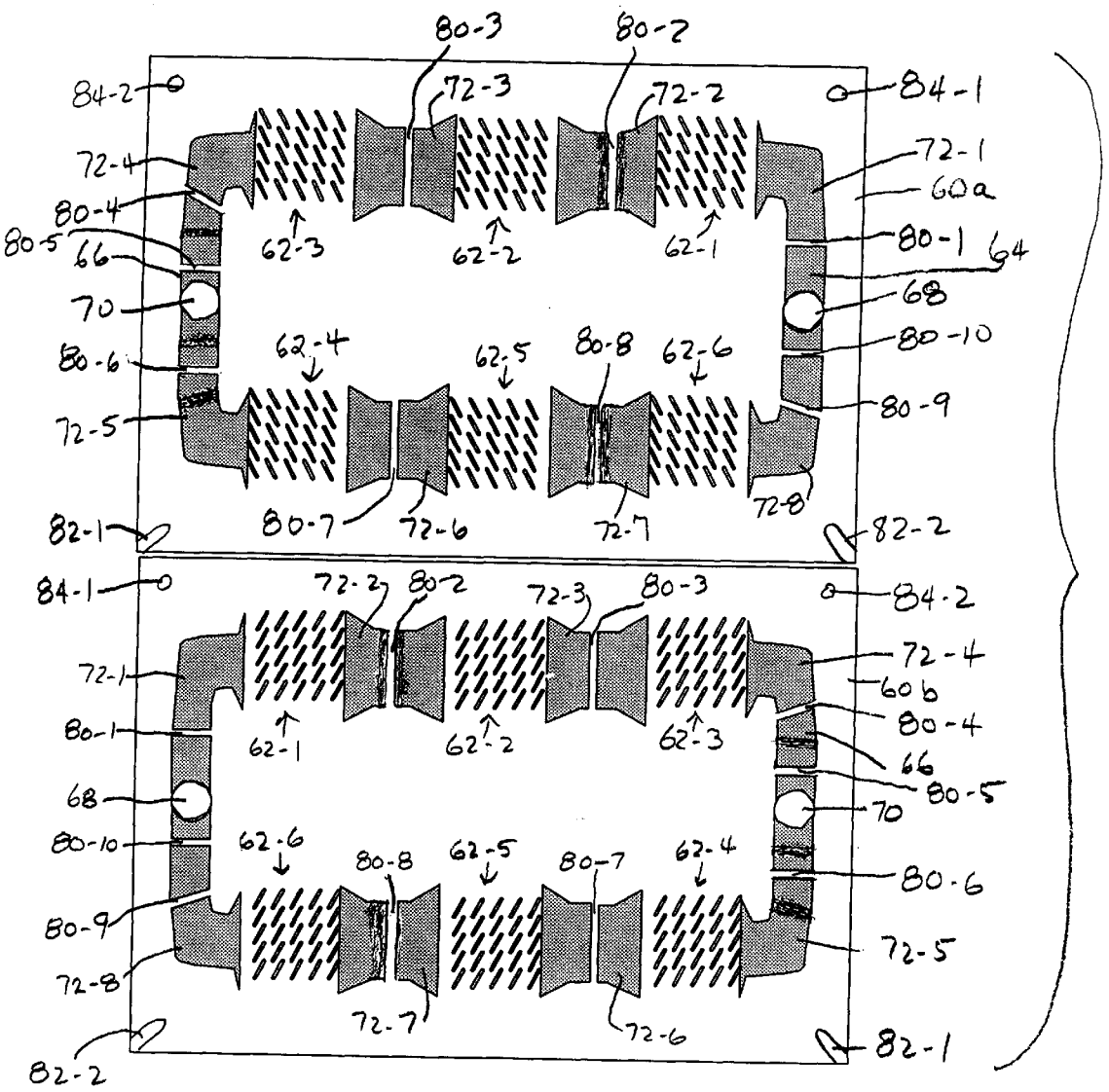
FIG. 7 is an elevational view of two cold plate laminations each having cooling zones according to the present invention.

FIG. 7 illustrates identical laminations 60*a*, 60*b* in different orientations (the lamination 60*b* is flipped side-to-side about a vertical axis as seen in the figure relative to the lamination 60*a*) wherein the laminations 60*a*, 60*b* may be stacked to obtain a cooling apparatus having multiple cooling zones each having the same zig-zag structure. Specifically, each lamination 60*a*, 60*b* includes cooler portions 62-1 to 62-6 and header portions 64, 66 in fluid communication with a flow port area 68, 70, respectively. Manifolds 72-1 through 72-8 are capable (when the laminations are stacked) of interconnecting the header portions 64 and 66 with the cooling areas 62 and the cooling areas 62 with one another. Optional support ribs are provided at locations 80-1 through 80-10 to provide structural integrity. The optional support ribs 80 are preferably (although not necessarily) nonsymmetric with respect to the vertical axis.

Figure 7A:
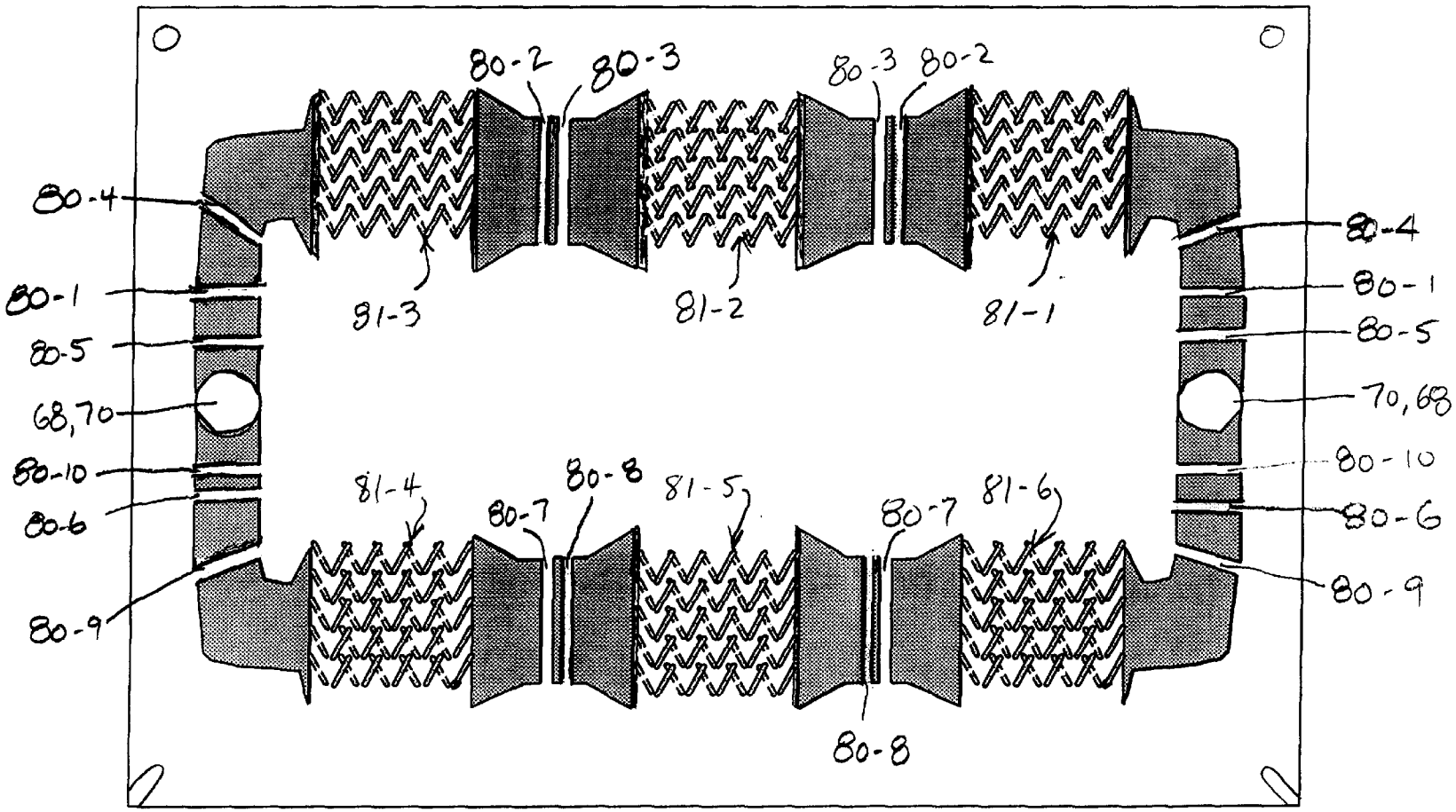
FIG. 7*a* is an elevational view of the laminations of FIG. 7 stacked atop one another.

When the laminations 60*a*, 60*b* are stacked (either alone or with other identical laminations) as seen in FIG. 7*a*, flow passages 81-1 through 81-6 are formed in the cooling areas 62, which passages are in fluid communication with adjacent manifolds 72 to provide fluid coolant paths between the flow port areas 68 and 70. In addition, because the support ribs 80-1 through 80-10 are preferably nonsymmetric with respect to the vertical axis, the ribs 80 in one lamination preferably do not substantially overlap the ribs 80 in the other lamination and thus fluid flow is not substantially impeded. The laminations 60 may be maintained in stacked and aligned relationship for bonding through pins (not shown) extending through aligned stacking slots 82-1, 82-2 and stacking holes 84-1, 84-2, and the stacked laminations may be maintained within a housing having fittings for conducting coolant to and away from the portions 68, 70.

If desired, any blank areas of the laminations may be provided with low pressure drop channels. Lower power devices can be mounted atop these channels and thus be cooled.

If desired, a different number of cooling areas 62 may instead be provided, in which case adjacent laminations (or groups of laminations) may be flipped about either a horizontal or a vertical axis (or any other axis) to obtain the zig-zag channels.

As should be evident from the foregoing, the present invention comprehends the use of a limited number of parts to obtain a simple cooler design, and thus costs can be reduced. Further cost savings are achieved because the same parts can be assembled into coolers having different performance and pressure drop characteristics. This flexibility allows a single design to serve several applications and thus be produced in greater quantities, thereby further reducing costs. In addition, surface densities on the order of 1000–3000 square meters of surface area per cubic meter of exchanger volume can be achieved.

Generally, it is preferred that fin efficiencies be between approximately 0.4 and 0.9. In the present device, coolant flow can be accommodated resulting in a fin efficiency of approximately 0.7, although a different flow rate resulting in a different fin efficiency could be accommodated instead. Generally, the foregoing can be accomplished by establishing a ratio of primary heat conduction path footprint area to total footprint area of approximately 0.4 to 0.9.

While the present invention comprehends the use of liquid coolants, two-phase boiling or gases may be used in certain applications. The present invention finds utility in many applications, particularly in aerospace applications when high powered electronic devices must be cooled as well as other applications.

Further, the laminations may be designed such that a lamination can be flipped about one axis only (such as one of the axes 18, 20) instead of about either of two axes. In this case, the optional headers need only be provided on two sides extending parallel to the axis.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. Cooling apparatus, comprising:

first and second identical laminations each having a plurality of openings wherein the openings of the first and second laminations are substantially coincident when the laminations are disposed in identical orientations and the first lamination is aligned with and overlies the second lamination and wherein the openings of each lamination are disposed in a regularly spaced pattern which is nonsymmetric with respect to two center lines of the lamination; and means for maintaining the first and second laminations in a stacked and aligned relationship and in different orientations wherein passages are formed extending through the laminations;

wherein the maintaining means maintains the first lamination in a first orientation and the second lamination in one of second and third orientations different than the first orientation.

2. The cooling apparatus of claim 1, wherein the openings in the laminations comprise slots.

3. The cooling apparatus of claim 1, wherein the openings are disposed in rows and columns between headers.

4. The cooling apparatus of claim 1, wherein each lamination has an overall shape having two axes of symmetry.

5. The cooling apparatus of claim 1, wherein the passages have a zig-zag shape when the stacked laminations are viewed in elevation.

6. The cooling apparatus of claim 1, wherein the maintaining means includes means for joining the laminations together in one of first and second orientation configurations.

7. The cooling apparatus of claim 6, wherein the passages have a first set of flow characteristics when the laminations are disposed in the first orientation configuration and a second set of flow characteristics different than the first set of flow characteristics when the laminations are disposed in the second orientation configuration.

8. The cooling apparatus of claim 1, wherein each lamination includes first through fourth sides and wherein the first lamination is disposed in a first orientation and the second lamination is disposed in a second orientation which is displaced 180 degrees about a central axis extending between the first and third sides of one of the laminations relative to the first orientation.

9. Cooling apparatus, comprising:

first and second identical laminations each having a plurality of openings wherein the openings of the first and second laminations are substantially coincident when the laminations are disposed in identical orientations and the first lamination is aligned with and overlies the second lamination and wherein the openings of each lamination are disposed in a regularly spaced pattern which is nonsymmetric with respect to a center line of lamination; and means for maintaining the first and second laminations in a stacked and aligned relationship and in different orientations wherein passages are formed extending through the laminations;

wherein each lamination includes first through fourth sides and wherein the first lamination is disposed in a first orientation and the second lamination is disposed in a second orientation which is displaced 180 degrees about a central axis extending between the first and third sides of one of the laminations relative to the first orientation; and wherein first through fourth headers are disposed adjacent the first through fourth sides, respectively, of each lamination and wherein the cooling passages extend between the second and fourth headers.

10. The cooling apparatus of claim 1, wherein each lamination includes first through fourth sides and wherein the first lamination is disposed in a first orientation and the second lamination is disposed in one of second and third orientations different than the first orientation, wherein the second orientation is displaced 180 degrees about a first central axis extending between the second and fourth sides of one of the laminations relative to the first orientation and the third orientation is displaced 180 degrees about a second central axis extending between the first and third sides of one of the laminations relative to the first orientation.

11. The cooling apparatus of claim 10, wherein first through fourth headers are disposed adjacent the first through fourth sides, respectively, and wherein the cooling passages extend between the first and third headers when the second lamination is disposed in the second orientation and wherein the cooling passages extend between the second and fourth headers when the second lamination is disposed in the third orientation.

12. The cooling apparatus of claim 10, wherein the first central axis is perpendicular to the second central axis.

13. The cooling apparatus of claim 10, wherein the cooling passages have one set of flow characteristics when the second lamination is disposed in the second orientation configuration and another set of flow characteristics different than the one set of flow characteristics when the second lamination is disposed in the third orientation configuration.

14. Cooling apparatus, comprising:

a plurality of substantially identical stacked laminations each lamination being flat and having openings; and means for securing the laminations together such that at least one lamination is flipped relative to another lamination to form cooling passages extending through the laminations;

wherein each lamination includes first through fourth sides arranged generally in a rectangle and wherein the openings are inclined relative to the four sides;

wherein a first lamination is disposed in a first orientation and a second lamination adjacent the first lamination is disposed in a second orientation which is displaced 180 degrees about a central axis extending between the first and third sides of one of the laminations relative to the first orientation; and wherein first through fourth headers are disposed adjacent the first through fourth sides, respectively, and wherein the cooling passages extend between the second and fourth headers.

15. Cooling apparatus, comprising:

a plurality of substantially identical stacked laminations each lamination being flat and having openings; and means for securing the laminations together such that at least one lamination is flipped relative to another lamination to form cooling passages extending through the laminations;

wherein each lamination includes first through fourth sides arranged generally in a rectangle and wherein the openings are inclined relative to the four sides;

wherein a first lamination is disposed in a first orientation and a second lamination adjacent the first lamination is disposed in a second orientation which is displaced 180 degrees about a central axis extending between the first and third sides of one of the laminations relative to the first orientation; and wherein first through fourth headers are adjacent the first through fourth sides, respectively, and wherein the cooling passages extend between the first and third headers when the second lamination is disposed in the second orientation and wherein the cooling passages extend between the second and fourth headers when the second lamination is disposed in the third orientation.

16. The cooling apparatus of claim 15, wherein the first central axis is perpendicular to the second central axis.

17. The cooling apparatus of claim 15, wherein the cooling passages have one set of flow characteristics when the second lamination is disposed in the second orientation configuration and another set of flow characteristics different than the one set of flow characteristics when the second lamination is disposed in the third orientation configuration.

18. Cooling apparatus, comprising:

a plurality of substantially identical stacked laminations each lamination being flat and having openings; and means for securing the laminations together such that at least one lamination is flipped relative to another lamination to form cooling passages extending through the laminations;

wherein the openings of each lamination are disposed in a regularly spaced pattern which is nonsymmetric with respect to a center line of the lamination;

wherein the openings in the laminations comprise slots;

wherein the openings are disposed in rows and columns between headers;

wherein each lamination includes four sides arranged generally in a square and wherein the openings are inclined relative to the four sides.

19. A method of assembling cooling apparatus, the method comprising the steps of:

providing first and second laminations each having a plurality of slots wherein the slots of the first and second laminations are substantially coincident when the laminations are disposed in identical orientations and the first lamination is aligned with and overlies the second lamination; and securing the first and second laminations in a stacked and aligned relationship and in different orientations wherein passages are formed extending through the laminations;

wherein each lamination includes first through fourth sides and wherein the step of securing includes the step of maintaining the first lamination in a first orientation and the second lamination in a second orientation which is displaced 180 degrees about a central axis extending between the first and third sides of one of the laminations relative to the first orientation;

wherein first through fourth headers are disposed adjacent the first through fourth sides, respectively, of each lamination and wherein the cooling passages extend between the second and fourth headers.

20. A method of assembling cooling apparatus, the method comprising the steps of:

providing first and second laminations each having a plurality of slots wherein the slots of the first and second laminations are substantially coincident when the laminations are disposed in identical orientations and the first lamination is aligned with and overlies the second lamination; and securing the first and second laminations in a stacked and aligned relationship and in different orientations wherein passages are formed extending through the laminations;

wherein each lamination includes first through fourth sides and wherein the step of securing includes the step of maintaining the first lamination in a first orientation and the second lamination in one of second and third orientations wherein the second orientation is displaced 180 degrees about a first central axis extending between the second and fourth sides of one of the laminations relative to the first orientation and the third orientation is displaced 180 degrees about a second central axis extending between the first and third sides of one of the laminations relative to the first orientation;

wherein first through fourth headers are disposed adjacent the first through fourth sides, respectively, and wherein the cooling passages extend between the first and third headers when the second lamination is disposed in the second orientation and wherein the cooling passages extend between the second and fourth headers when the second lamination is disposed in the third orientation.

21. The method of claim 20, wherein the cooling passages have one set of flow characteristics when the second lamination is disposed in the second orientation configuration and another set of flow characteristics different than the one set of flow characteristics when the second lamination is disposed in the third orientation configuration.

* * * * *